US007198614B2

(12) United States Patent
Kappauf

(10) Patent No.: US 7,198,614 B2
(45) Date of Patent: Apr. 3, 2007

(54) METHOD AND APPARATUS FOR ADAPTING CLOTHING TO ALLOW ACCESS FOR MEDICAL PROCEDURES

(75) Inventor: Charles H. Kappauf, Greensboro, NC (US)

(73) Assignee: Charlie's Chemo T-Shirts, Inc., Greensboro, NC (US)

( * ) Notice: Subject to any disclaimer, the term of this patent is extended or adjusted under 35 U.S.C. 154(b) by 0 days.

(21) Appl. No.: 11/138,119

(22) Filed: May 26, 2005

(65) Prior Publication Data

US 2006/0180162 A1 Aug. 17, 2006

Related U.S. Application Data

(60) Provisional application No. 60/651,896, filed on Feb. 11, 2005.

(51) Int. Cl.
*A61M 5/00* (2006.01)
*A41B 9/00* (2006.01)

(52) U.S. Cl. ..... 604/116; 2/69; 2/114

(58) Field of Classification Search ..... 2/114, 2/128, 69; 604/116; 128/849, 850, 853, 128/854; 434/84, 87
See application file for complete search history.

(56) References Cited

U.S. PATENT DOCUMENTS

| | | | | |
|---|---|---|---|---|
| 3,840,113 | A * | 10/1974 | Bartleson | 206/575 |
| 4,931,017 | A * | 6/1990 | Mann | 434/87 |
| 5,511,316 | A * | 4/1996 | Fischer et al. | 33/1 F |
| 5,919,479 | A * | 7/1999 | Zhang et al. | 424/449 |
| 6,438,758 | B1 * | 8/2002 | Burkard et al. | 2/115 |
| 6,619,172 | B2 * | 9/2003 | Nichols et al. | 83/565 |
| 2005/0252019 | A1 * | 11/2005 | Gordon et al. | 33/566 |

OTHER PUBLICATIONS

ZARS Inc. http://www.zars.com/scainepatch.html.*

* cited by examiner

*Primary Examiner*—Kevin C. Sirmons
*Assistant Examiner*—Benjamin Huh
(74) *Attorney, Agent, or Firm*—Fulbright & Jaworski LLP

(57) ABSTRACT

The present invention is directed to a method and apparatus for positioning and creating an opening in a person's shirt or blouse at a location that varies depending on the underlying location necessary to perform a medical procedure. The created opening allows access to a porta-cath without requiring the patient to remove his/her shirt/blouse.

3 Claims, 3 Drawing Sheets

METHOD AND APPARATUS FOR ADAPTING CLOTHING TO ALLOW ACCESS FOR MEDICAL PROCEDURES

RELATED APPLICATIONS

The present application claims the benefit of U.S. Provisional Patent Application No. 60/651,896, entitled "CHEMO T-SHIRT KIT," filed Feb. 11, 2005, the disclosure of which is hereby incorporated herein by reference.

BACKGROUND OF THE INVENTION

Patients undergoing medical procedures, whether in a hospital or in an outpatient setting, often find themselves in an uncomfortable environment. Many things, including the anxiety of having a medical procedure performed on their person, contribute to the discomfort experienced by the patients. In order to perform a procedure, a healthcare provider must have access to the site where the procedure is to be performed. This often results in patients having to take off all or some of their clothes, further increasing their level of anxiety. Without their clothes to protect them from the environment, the cool temperatures of the procedure room can cause patients to feel cold.

One medical procedure that requires access to specific body sites is the administration of chemotherapy. In order to make venous access easier and to facilitate delivery of the chemotherapy to patients, doctors implant porta-caths in the patients. The porta-cath can be implanted subcutaneously, and accessed with a needle each time the patient needs chemotherapy. The actual location of the porta-cath depends upon the surgeon's placement. Thus, the location of the access site varies from patient to patient. Because the site is typically located somewhere on the chest, the patient's clothing usually covers the access site. The patient is required to pull his/her shirt/blouse up, or take it off altogether, leaving the patient exposed to the environment. This can be uncomfortable depending on the temperature of the room where the chemotherapy is administered. For women, this invasion of their modesty increases their discomfort.

Some articles of apparel are designed to allow access to specific parts of the anatomy. There are bras designed to allow an infant access to the mother's breast for nursing. Underpants are designed to allow a person to use the restroom. Ski masks have openings for the eyes and the mouth. All of these items have one thing in common, namely they are designed and manufactured with a known fixed location for the opening that allows access to the body. In such manufactured articles, there is no ability to vary the location of the opening depending on the needs of the individual.

The present invention is directed to a method and apparatus for positioning and creating an opening in a person's shirt or blouse at a location that varies depending on the underlying location necessary to perform a medical procedure. The created opening allows access to a porta-cath without requiring the patient to remove his/her shirt/blouse.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION

Figure 1:
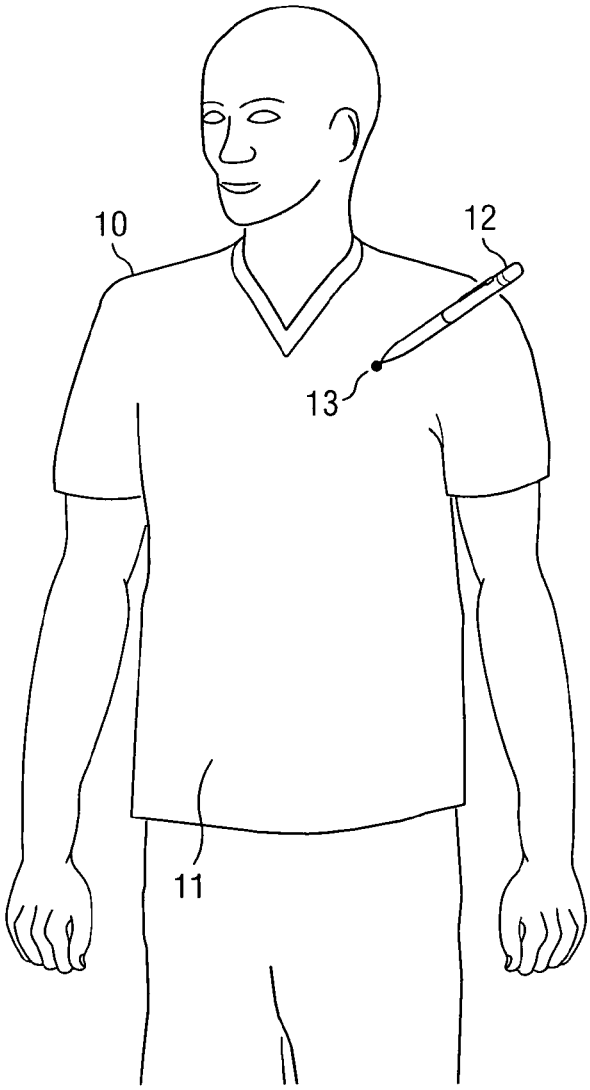
FIG. 1 shows one embodiment of marking the location of the porta-cath while the patient is wearing a T-shirt.

In one embodiment, as shown in FIG. 1, patient 10 is wearing T-shirt 11, which is to be adapted to allow access to a porta-cath (not shown, but located where dot 13 is to be placed) during the administration of chemotherapy. While the T-shirt is being worn by the patient, the porta-cath (401, FIG. 4A) is located underneath T-shirt 11 (or any other article of clothing covering the site of a medical procedure). Then, marker 12, preferably a permanent marker, is used to place mark 13 on the T-shirt corresponding to the location of the porta-cath (or the site of the medical procedure) underneath the article of clothing. To locate the porta-cath underneath the T-shirt, the person placing the mark feels for the bump caused by the porta-cath. Mark 13 is placed directly on top of the bump identifying the porta-cath.

In other embodiments, marker 12 can be anything that leaves an identifiable mark on the T-shirt. The marker can be a permanent marker, an ink pen, a pencil, a highlighter, or any other means for leaving an identifiable mark on the T-shirt. One could place a sticky marker or a pin on the location, or make a small hole to mark the area. Any method of making a mark that would allow the location of the porta-cath to be identified once the shirt is removed would suffice.

Figure 2A:
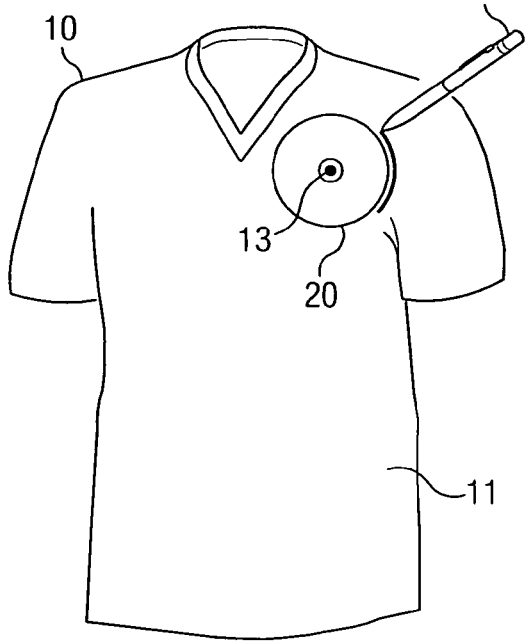
FIG. 2A shows one embodiment for creating a cutting pattern on a T-shirt.
Figure 2B:
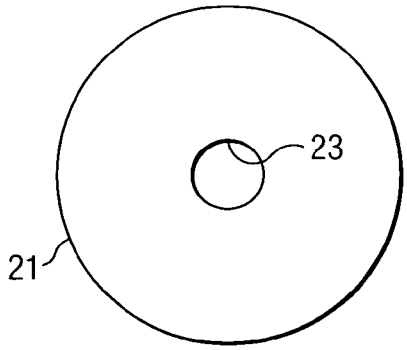
FIG. 2B show one embodiment of a template.

As shown in FIG. 2A, after the location of the porta-cath is marked on the T-shirt, it is removed. Then, circumference 20 of an appropriate sized opening is marked on the T-shirt. This circumference can be made by centering template 21, designed with hole 23 in the center (as shown in FIG. 2B), allowing the template to be positioned over mark 13. The circumference could be any size and shape appropriate for the medical procedure. In one embodiment, the template is circular with a diameter of 3.5 inches. Once the template is properly positioned, the patient (or any other person) can trace circumference 20 onto the T-shirt by using, for example, marker 12.

Figure 3A:
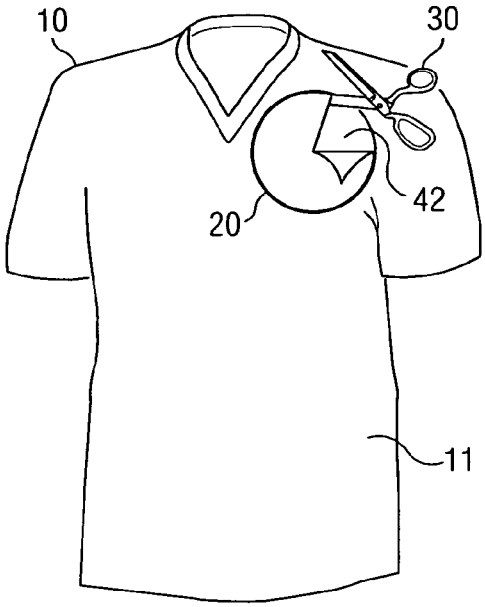
FIG. 3A shows one embodiment for creating an opening corresponding to the pattern created on the T-shirt.

FIG. 3A shows T-shirt 11 with circumference 20 traced onto it. Using a pair of scissors 30, a hole is poked in the center of marked circumference 20, through which the scissors can be used to cut an opening in T-shirt 11 corresponding to the shape of the template. A person skilled in the art would recognize that any instrument with an appropriate cutting surface could be used to create the opening.

Figure 3B:
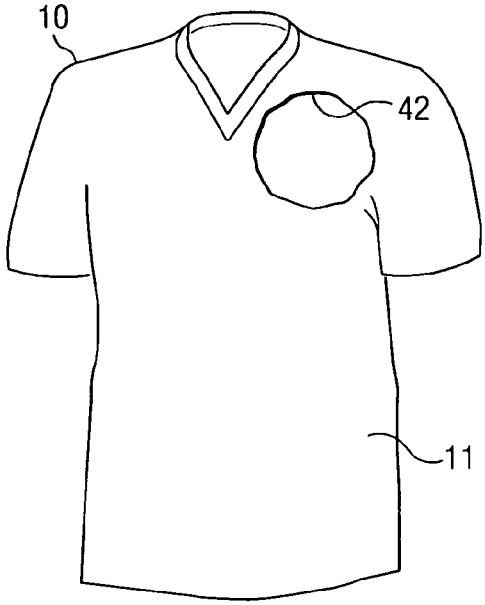
FIG. 3B shows a hole created in the T-shirt.

FIG. 3B shows T-shirt 11 with created opening 42.

Figure 4A:
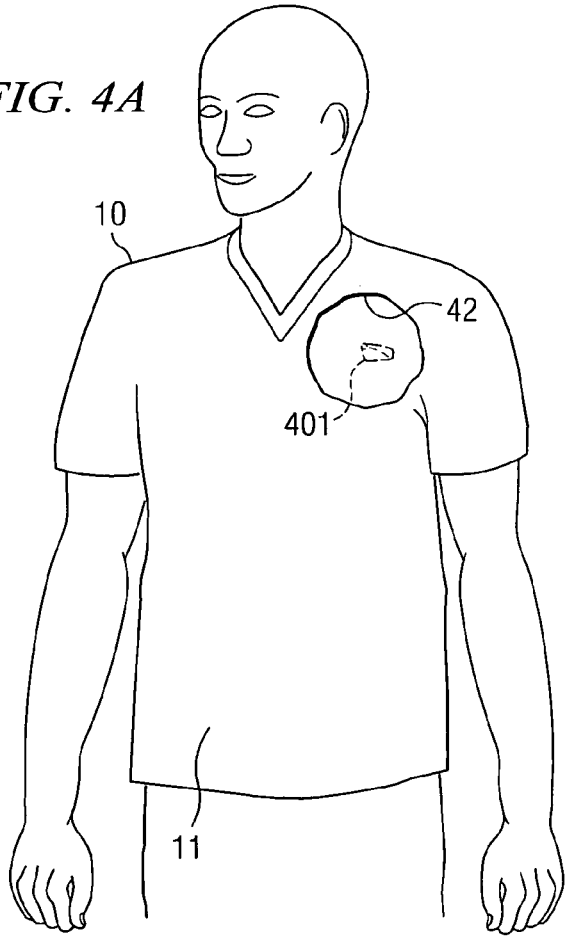
FIG. 4A shows a patient wearing a T-shirt with an opening created over a porta-cath.

FIG. 4A shows patient 10 wearing T-shirt 11 with opening 42 positioned over the porta-cath 401.

Figure 4B:
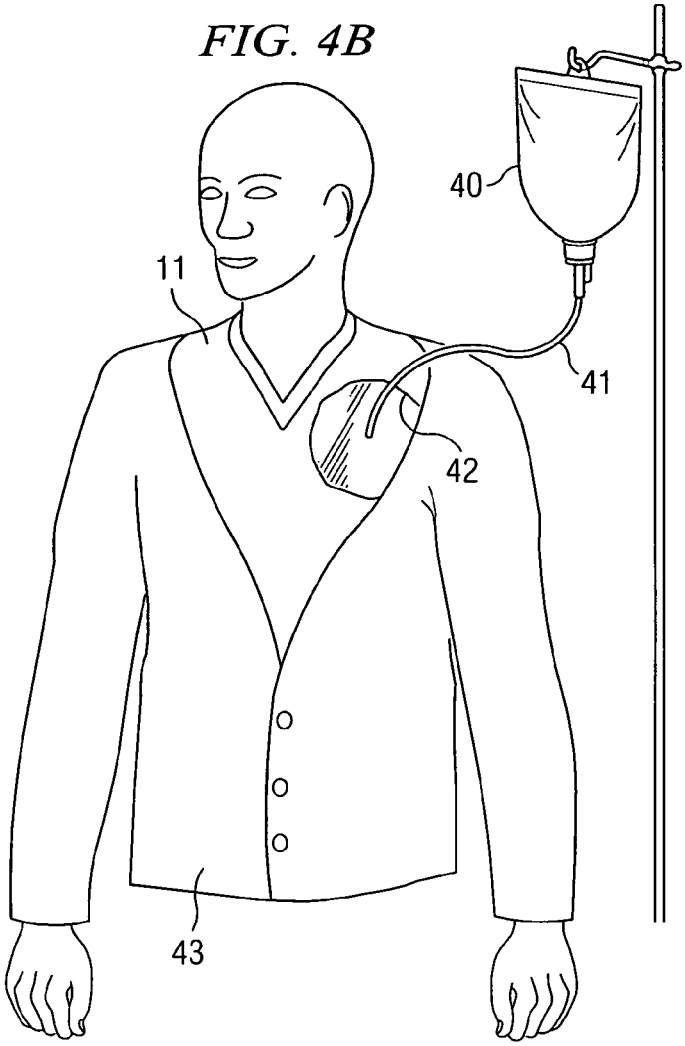
FIG. 4B shows the porta-cath site being accessed via the created opening in the T-shirt.

FIG. 4B shows patient 10 wearing T-shirt 11 (under gown 43 which is optional) with opening 42 created for the administration of chemotherapy via tubing 41 extending from bag 40 into the porta-cath via opening 42. The medical personnel use opening 42 to access the porta-cath during the administration of the chemotherapy. This procedure allows the patient a degree of comfort during an otherwise unpleasant experience.

Another embodiment allows the creation of a non-permeable cover to place over an anesthetic applied to the skin over the porta-cath. To make access to the porta-cath less painful, patients place a local anesthetic on the skin over the porta-cath to anesthetize the skin for insertion of a needle to access the porta-cath. In order to create the cover, the patient needs a non-permeable material, such as a common household sandwich bag. The non-permeable material should be of sufficient size to allow the cover to be traced onto, and cut from, the material.

Figure 5A:
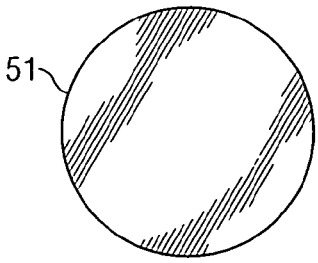
FIG. 5A & 5B show embodiments to create anesthetic covers.
Figure 5B:
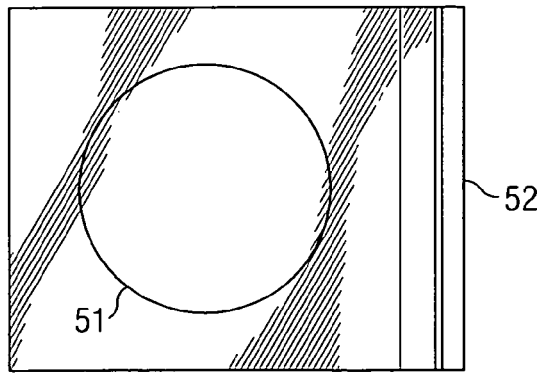

To create the cover, a second template 51 as shown in FIG. 5A, of smaller circumference than that of template 21, is placed on a non-permeable material such as a sandwich bag 52 as shown in FIG. 5B. The circumference of template 51 is marked on the non-permeable material using a marker, for example, marker 12. Then, a cover of the non-permeable material is created by cutting around the traced circumference. This could also be accomplished by a person placing the template on the non-permeable material and cutting around the circumference of the template without first marking the material. In one embodiment, the template is circular and the diameter is 2.5 inches. After creating the finished cover, the patient applies the anesthetic either to one side of the cover, or to the skin covering the porta-cath. Then, the cover is placed over the anesthetic in contact with the skin that lies directly over the porta-cath. The cover can be secured to the skin with an adhesive such as surgical tape.

In another embodiment, an opening is created, but the material is left in place with a small uncut portion of material acting like a hinge to create a flap. To create the hinged opening, the template is used to trace the circumference, but a portion of the material around the circumference is not marked, and is not cut by the scissors. Typically, the uncut portion would be at the top of the circumference. With the uncut portion at the top, the flap will hang down in the closed position when the person is upright, further protecting the modesty and comfort of the patient. Thus, the uncut portion creates a hinge to hold the cloth in place when not in use, but allows the flap of material to be moved out of the way during access.

In other embodiments different sizes of templates could be used for different medical procedures. The only requirement being that the patient knows ahead of time where the medical procedure is going to be performed. For instance, if the patient needs to receive several injections to a particular joint, such as to a shoulder or to a knee joint, the physician could mark the appropriate location on the patient. If the mark cannot be seen through the clothing, then an artificial bump with adhesive on one side could be placed on the location identified by the physician. The patient could feel the artificial bump and mark the clothing in the appropriate location. Then, templates of appropriate sizes could be used to create an opening in the clothing to allow access to the area underneath. One skilled in the art would appreciate the adaptability of the present invention for a multiplicity of procedures necessitating access to different locations on the body.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for adapting a shirt/blouse of a patient for use during chemotherapy, the method comprising:

locating an area of said shirt/blouse over a porta-cath variably positioned under the patient's skin;

marking said located area on said shirt/blouse, wherein said marking comprises:

placing a mark on said shirt/blouse where said shirt/blouse contacts said porta-cath;

creating an opening in said shirt/blouse that circumscribes said marked area, wherein said creating comprises:

selecting a template;

centering said selected template over said marking;

outlining a circumference of said template on said shirt/blouse to create outlined circumference; and cutting an opening in said shirt/blouse at least partially along said outlined circumference;

wherein said opening is large enough to access and anesthetize the patient's skin over said porta-cath; and receiving said chemotherapy administered via said porta-cath through said opening;

wherein said locating and marking are performed while the patient is wearing said shirt/blouse, and wherein said creating is performed after said patient has removed said shirt/blouse.

2. The method of claim 1 wherein said selected template is a circle with a diameter of 3.5 inches.

3. The method of claim 1 further comprising:

creating a cover for said porta-cath, said created cover having a circumference smaller than said created opening in said shirt/blouse;

placing anesthetic on said skin over said porta-cath;

securing said cover over said anesthetic and centered on said porta-cath, said secured cover being removable through said opening without removing said shirt/blouse.

* * * * *